US006293986B1

(12) United States Patent
Rödiger et al.

(10) Patent No.: US 6,293,986 B1
(45) Date of Patent: Sep. 25, 2001

(54) HARD METAL OR CERMET SINTERED BODY AND METHOD FOR THE PRODUCTION THEREOF

(75) Inventors: Klaus Rödiger, Bochum; Klaus Dreyer, Essen; Monika Willert-Porada; Thorsten Gerdes, both of Dortmund, all of (DE)

(73) Assignee: Widia GmbH, Essen (DE)

( * ) Notice: Subject to any disclaimer, the term of this patent is extended or adjusted under 35 U.S.C. 154(b) by 0 days.

(21) Appl. No.: 09/367,004

(22) PCT Filed: Mar. 6, 1998

(86) PCT No.: PCT/DE98/00674

§ 371 Date: Aug. 4, 1999

§ 102(e) Date: Aug. 4, 1999

(87) PCT Pub. No.: WO98/40525

PCT Pub. Date: Sep. 17, 1998

(30) Foreign Application Priority Data

Mar. 10, 1997 (DE) ..... 197 09 527
Jun. 19, 1997 (DE) ..... 197 25 914

(51) Int. Cl.[7] ..... C22C 29/02

(52) U.S. Cl. ..... 75/236; 75/240; 419/14; 419/45

(58) Field of Search ..... 75/240, 242, 236; 419/45, 14

(56) References Cited

U.S. PATENT DOCUMENTS

| | | |
|---|---|---|
| 3,647,401 | 3/1972 | Meadows . |
| 5,451,365 | 9/1995 | Barsoum . |

FOREIGN PATENT DOCUMENTS

| | | |
|---|---|---|
| 522 038 | 6/1972 | (CH) . |
| 196 01 234 A1 | 7/1997 | (DE) . |
| 0 448 572 B1 | 10/1991 | (EP) . |
| 0 759 480 A1 | 2/1997 | (EP) . |
| 6003913728 | 2/1985 | (JP) . |
| WO 96/22399 | 7/1996 | (WO) . |

OTHER PUBLICATIONS

Microwave Sintering of Tungsten Carbide Cobalt Hardmetals by T. Gerdes et al. (Mat.Res.Soc.Sym.Proc.vol.430 1995 (pp. 45–50).

Microwave Reaction Sintering of Tungsten Carbide Cobalt Hardmetals (same as above) (pp. 175–180).

*Primary Examiner*—Ngoclan Mai
(74) *Attorney, Agent, or Firm*—Herbert Dubno

(57) ABSTRACT

A hard metal or cermet sintered body and a method of making it wherein a solid phase containing WC and a binder phase are formed together with WC platelets by direct microwave irradiation, utilizing reactive sintering to form the WC at least in part and to produce the platelets.

12 Claims, 5 Drawing Sheets

REM photos of the structure or reactively sintered WC-6Co hard metals of 2.4 µm-W-powder a/ MWRS with 0.2 % VC b/ RS with 0.2 % VC c/ MWRS without VC d/ RS without VC REM-photos of the structure of reactively sintered WC-6Co- hard metals of 0.4 μm-W-powder a/ MWRS with 0.2 % VC
b/ RS with 0.2 % VC
c/ MWRS witout VC
d/ RS without VC

HARD METAL OR CERMET SINTERED BODY AND METHOD FOR THE PRODUCTION THEREOF

CROSS REFERENCE TO RELATED APPLICATIONS

This application is a national stage of PCT/DE98/00674 filed Mar. 6, 1998 and based upon German national applications 197 09 527.5 of Mar. 10, 1997 and 197 25 914.6 of Jun. 19, 1997 under the International Convention.

FIELD OF THE INVENTION

The invention relates to a hard metal or cermet sintered body, consisting of at least one hard material phase containing WC and a binder phase, as well as embedded WC platelets (plate-shaped reinforcing materials).

BACKGROUND OF THE INVENTION

A hard metal composite body of hard material phases, such as tungsten carbide and/or carbides or nitrides of the elements of Groups IVa or Va of the periodic classification of elements, comprising reinforcing materials and a binder phase, such as cobalt, iron or nickel, is known from EP 0 448 572 B1 which contains as reinforcing materials either monocrystalline platelet-shaped reinforcements of borides, carbides, nitrides or carbonitrides of elements of the Groups IVa or VIa of the periodic classification of elements, or mixture thereof, or of SiC, $Si_3N_4$, $Si_2N_2O$, $Al_2O_3$, $ZrO_2$, AlN and/or BN. The proportion of reinforcing materials amounts to 2 to 40% by volume, preferably 10 to 20% by volume.

U.S. Pat. No. 3,647,401 describes anisodimensional tungsten-carbide platelets with a maximum dimension between 0.1 and 50 $\mu$m and a maximal expansion which is at least three times the minimal expansion. These platelets are bound by cobalt, in an amount of 1 to 30% in relation to the total body weight. The body has a density of 95% of the theoretical maximum density.

The CH 522 038 describes a hard metal sintered body with tungsten carbide particles, whose average grain size is smaller than 1 $\mu$m, whereby at least 60% of the particles are smaller than 1 $\mu$m. The metal phase proportion ranges between 1 and 30% and is composed of 8 to 33% by weight tungsten and 67 to 62% by weight cobalt. The anisodimensional WC particles should be aligned with their largest surface practically parallel to a reference line.

Finally the WO 96/22399 describes a multiphase sintered body, which has a first hard phase of carbides, nitrides, carbonitrides or carboxinitrides of the element of Groups IVa, Va or VIa metals of the classification of elements. The second phase consists of a solid solution with a grain size between 0.01 and 1 $\mu$m of carbides, nitrides, carbonitrides and carbonitrides of at least two elements of the Groups IVa to VIa of the classification of elements. The binder is composed of cobalt, nickel, chrome, molybdenum and tungsten, as well as mixtures thereof. The sintered body can contain WC platelets of tungsten carbide with a size ranging between 0.1 and 0.4 $\mu$m, which are formed in situ.

Since the first WC—Co hard metals have been invented and produced more than 70 years ago, activity in research and development laboratories has been directed to the improvement of the characteristics of these alloys and to optimize them for the ever increasing utilization possibilities. Particularly in the field of machining—a main utilization field of hard metals—during the further development of the materials to be processed, new hard metal alloys were continuously developed, which were characterized by an increase in not only the wear resistance of the cutting bodies, but also their strength. The coating of hard metal substrates with hard and wear resistant layers, as well as lately the introduction of refined and ultra-fine grained hard metals, in which the simultaneous increase of hardness and bending resistance was made possible with a decrease of the carbide size, represent important stages in the history of this development.

Particularly with the production of ultra-fine grain alloys of ultra-fine and nano-fine starting powders it had become clear that the conventional production methods reach limits during sintering, due to problems in the processing of powders and the grain enlargement.

This raises the problem whether and to what extent the conventional production methods have to be developed anew, or further developed, in order to promote continuing development of hard metal alloys, so that new concepts of composite cutting materials with improved characteristics can be implemented technically and economically. In this respect the sintering of hard metals in a microwave field offers itself as a new technology, affording entirely new solutions.

Microwaves are defined as an electromagnetic radiation in the frequency range of approximately $10^8$ to $10^{11}$ Hz (corresponding to the wavelength in vacuum of about 1 mm to 1 m). Commercially available microwave generators produce a monochromatic radiation, i.e. waves with a certain frequency. Widely used are generators with 2.45 $10^9$ Hz, which corresponds to a wavelength of 12 cm. By contrast therewith the thermal radiation (Planck radiation) has a very broad frequency band width and in typical sintering processes it has its energy maximum at a wavelength of 1 to 2 $\mu$m. Matter exposed to an electromagnetic radiation can become heated as a result of the interaction with the field, thereby draining the wave field of energy. Since this interaction is strongly frequency-dependent, the heating of matter takes place in the microwave field and also through thermal radiation based on various heating mechanisms.

Most solid materials have sufficiently strong absorption bands in the infrared wave length range and can be heated by heat radiation which is absorbed at the body surface. As a rule the transport of the heat energy towards the body interior takes place by heat conduction, resulting in a temperature gradient in the body from the inside out. If in a sintering oven there is a batch of parts (sinter charge), which is heated by a peripheral heat conductor, then for reasons which are analogous to the case of the individual body, a temperature gradient develops across the sinter charge. If the aim is to insure a certain temperature homogeneity inside the sinter charge, i.e. to keep the temperature gradient small, then the heating rate has an upper limit because of the thermal inertia of the charge and the oven. Therefore a certain minimal dwelling time is predetermined for corresponding temperatures.

The interaction of matter with a microwave field takes place through the electric dipoles existing in the material or free charges. The scale of the absorption characteristics of materials for microwaves extends from transparent (oxide ceramic, several organic polymers), through the partially transparent (oxide ceramic, nonoxide ceramic filled polymers, semiconductors) up to reflective (metals). Further the behavior of a material in the microwave field depends on the microwave frequency and in large measure upon the temperature. A material which at room temperature is microwave transparent, can at higher temperatures become strongly absorptive or reflective. For most material the penetration depth of the microwaves is considerably greater than for the infrared radiation, which depending on the sample size, results in the fact that the material—in contrast to the "skin heating" of the infrared radiation—can be heated through its volume with microwaves. The penetration depth of microwaves of the frequency 2.45 GHz at a temperature of 20° C. (calculated from measuring the dielectric constants) varies in different materials and has the following values: 1.7 $\mu$m for aluminum, 2,5 $\mu$m for cobalt (as an example of a metal), 4.7 $\mu$m for WC and 8.2 $\mu$m for TiC (as examples of massive semiconductors), 10 m for $Al_2O_3$ and 1.3 cm for $H_2O$ (as examples of insulators) and 7.5 cm for WC with 6 M % Co, 31 cm for $Al_2O_3$ with 10 M % Al and 36 cm for $Al_2O_3$ with 30 M % TiC (as examples of powder metal green compacts).

The sintering of ceramic materials, such as silicon nitride, aluminum oxide or a mixed ceramic in the microwave field has been known for more than 10 years. But since the beginning of worldwide activity in the field of microwave sintering, it was prevailing opinion that this technology can not be used for the sintering of materials with a high electric conductivity, such as for instance hard metals. This opinion was based on the fact that massive metallic bodies can practically not be heated, since they reflect the microwaves well due to their high electric conductivity and only a superficial layer several micrometers thick can be heated via eddy currents. However it has been surprisingly found that the dissipation behavior of metallic-ceramic compressed bodies produced according to powder metallurgy depends not only on the electric conductivity of the participating phases, but in large measure on the microstructure, and that an effective heating of metallic powders is very well possible. In a sufficiently fine distribution of the metallic phases in a mixture with nonconductive or semiconductive powders (such as for example WC—Co compressed powder bodies) an extremely effective heating takes place, which seen microscopically is based on "ohmic losses" between the grains and high frequency eddy currents at the individual grain. From the previously mentioned penetration depths the behavioral difference in the microwave field between massive bodies and compressed bodies produced through powder metallurgy can be clearly seen. More precise tests have shown that the penetration depth of the microwaves in metallic, respectively semiconductive compressed bodies also depends on the power of the microwave field and decreases clearly at higher output densities. This phenomenon is explained by the shielding of the sample with electrically conductive plasmas, which in the marginal area of the porous compressed bodies are ionized in the pores after the penetrating power has been reached.

By taking into consideration the interaction of the of microwaves with the introduced green compacts produced through powder metallurgy, the hard metals can be sintered by means of microwave until they reach their final theoretical density.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
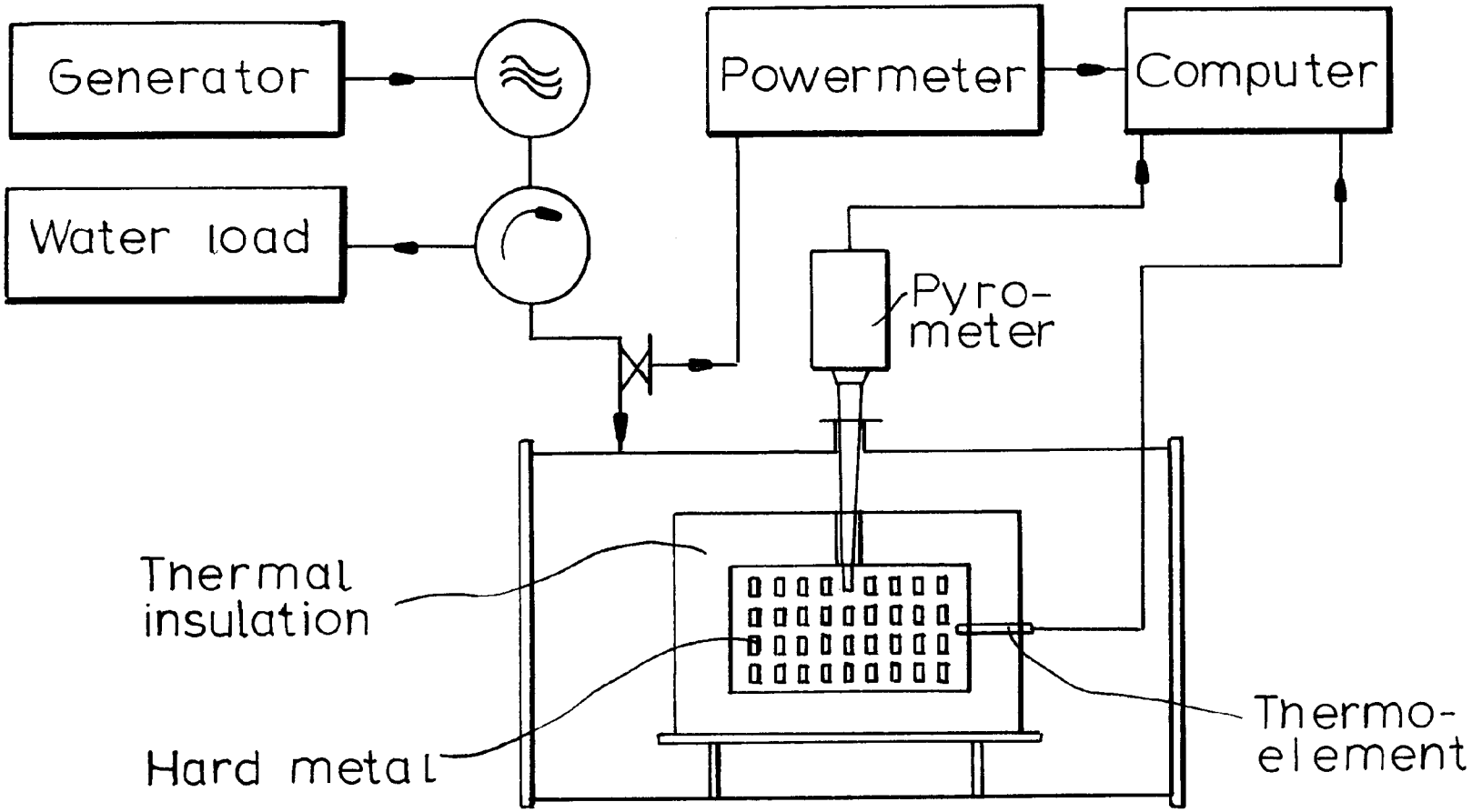
FIG. 1 is a diagram showing schematically the construction of a microwave oven.

FIG. 1 shows schematically the construction of an oven suitable to the purpose. The microwaves with a frequency of 2.45 GHz are produced by a magnetron and are fed into the metallic resonator housing. Inside the resonator there is the hard metal sinter charge, which is surrounded by a microwave transparent, thermal insulation. With a corresponding layout of the resonator, the charge is located in a homogeneous magnetic field and is homogeneously heated. The measuring of the charge temperature, as well as the coupled-in microwave power serve for the adjustment of the microwave sintering processes with a microprocessor. Comparisons of the sintering profile of a microwave sintering with the conventional sintering in ovens of comparable size have shown that the sintering cycle (without the cooling phase) can be shortened in time by a factor of 3 in microwave sintering. Due to the shortening of the process time and the reduced heat output during sintering, the electric energy consumption in the microwave sintering technology amounts to only a fraction of the value for the conventional sintering technology. With the microwave sintering hard metals and also cermets with a high content of binder metal (e.g. 25% by mass), as well as with a low content of binder metal (for instance 4% by mass) can be sintered densely without pressure at temperatures which are 50 to 100 K lower than in conventional sintering. The comparison with conventional sintering shows that the main part of the densification takes place in microwave sintering at a substantially lower temperature, even below the eutectic temperature. The improved densification behavior shows up also in the simultaneous reduction of open and closed pores during microwave sintering. Based on the shorter sintering times and the lower sintering temperatures, the microwave sintered hard metals show a finer structure and a hardness increase of up to 10%. Used as cutting tools in the machining of cast iron, the microwave sintered product presents advantages with respect to the wear of the tool flanks. The microwave sintering of cermets, hard metals and steel types produced through powder metallurgy is described for instance in the WO 96/33830, which is here included by reference.

Figure 2:
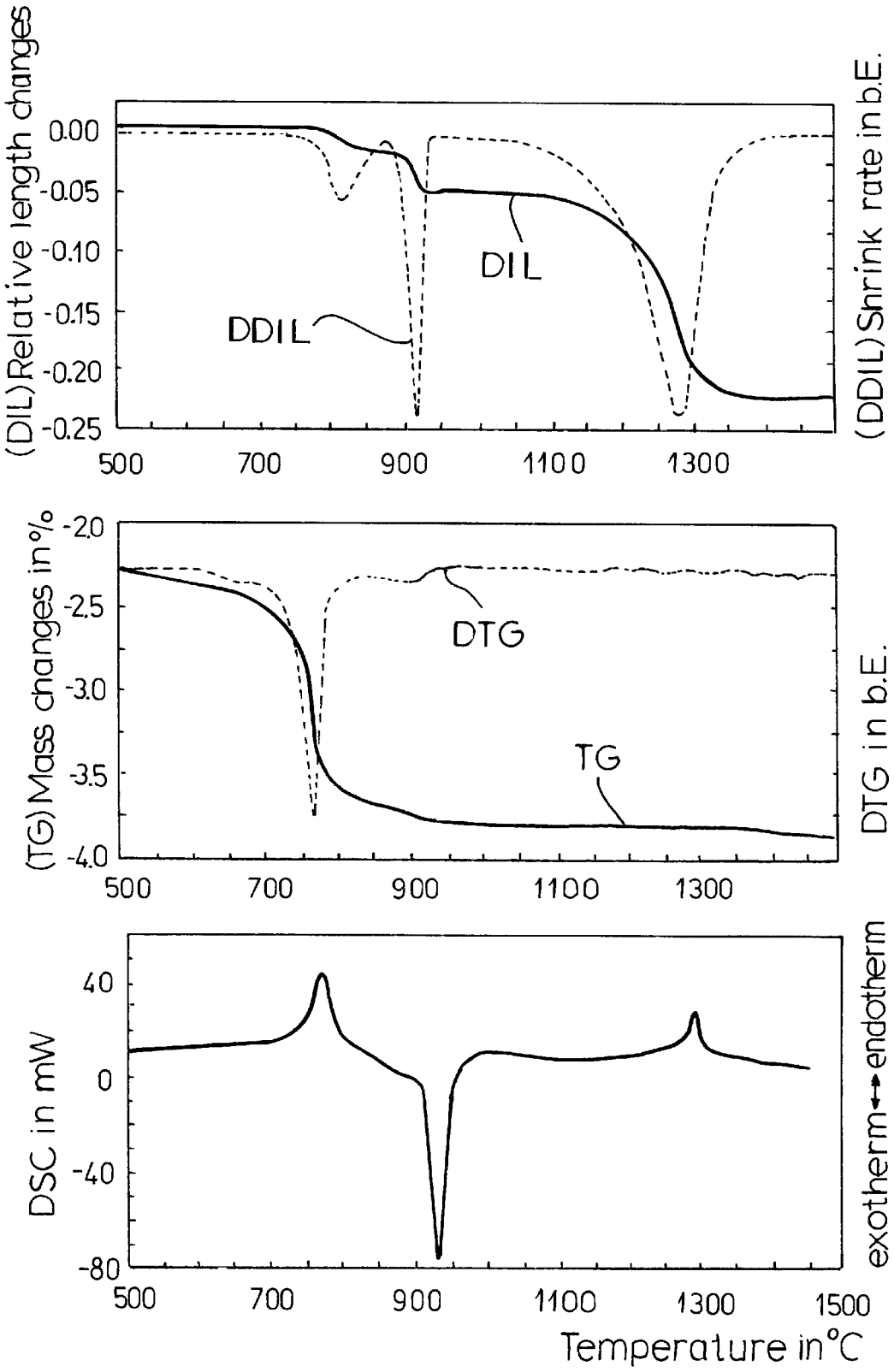
FIG. 2 is a set of graphs showing the thermogravimetrics, the dilatometrics and the dynamic differential calorimetric curve in a reactive sintering depending on the temperature.

A further step in the direction of the optimization of the finishing process and a further grain refining is represented by the reactive sintering of hard metals. So for instance tungsten powder need no longer be reacted with carbon in a separate process step, due to the fact that the carbonizing is integrated in the sintering process. The compressed bodies are produced in the usual manner by molding, in that instead of the tungsten carbide-cobalt powder mixture, the process starts from a mixture of tungsten, carbon and cobalt powders. The exothermic carbonizing reaction of the tungsten and the carbon into tungsten carbide, with a thermal effect of 38 kJ/mol, takes place after binder elimination from the compressed body at a temperature of about 930° C. The resulting reaction heat contributes to the heating of the in the volume of the compressed body and makes possible a shortening of the sintering process. In FIG. 2, the thermogravimetrics (TG, DTG), the dilatometrics (DIL, DDIL) and the dynamic calorimetric curve (DSC) of a reactive sintering of a WC—6 M % Co hard metal for temperatures starting at 500° C. are represented. On the DSC signal from 750° C. up, the endothermic reduction of the oxides present in the tungsten powder can be recognized, which corresponds with the corresponding mass reduction in the thermogravimetry and with a first shrinking stage of the sample in the dilatometric signal. At about 930° C. in the exothermic amplitude of the DSC signal, the carbonizing of the tungsten is recognized, combined with a further shrinking of the sample. At 1290° C. the liquid phase forms, at this point in time the shrinking of the sample is almost concluded.

Due to the elimination of the separate carbonizing step and the thereby shortened thermal treatment, the structures of hard metals produced by reactive sintering have a clearly finer microstructure than conventionally sintered materials.

If the reactive sintering is performed by using microwave irradiation (MWRS), then on the one hand a further refining of the structure is possible, and on the other hand the residual porosity can be noticeably lowered with respect to the conventional reactive sintering (RS). With the use of identical tungsten powders, a continuous reduction of the WC grain size and the therewith connected increase in hardness is possible, from the conventional sintering process to the microwave sintering process, to the conventional reactive sintering and finally to the microwave reactive sintering. The Vickers hardness (HV30) amounted after conventional sintering to 1560, after the microwave sintering to 1630, after the conventional reactive sintering to 1720 and after the microwave reactive sintering to 1770.

In addition to the mentioned advantages of reactive sintering, particularly of the microwave reactive sintering, which are specific to the material, this process has great potential for the simplification and shortening of the process, as well as for energy savings in the production of hard metals. In addition to the carburetting taking place at high temperatures, also preliminary and subsequent process steps can be eliminated, such as mixing, breaking, comminuting, etc. Here too a reduction of the process time can be achieved.

The production of a cermet or a hard metal according to such a process is described in the German patent application 196 01 234.1.

Figure 3:
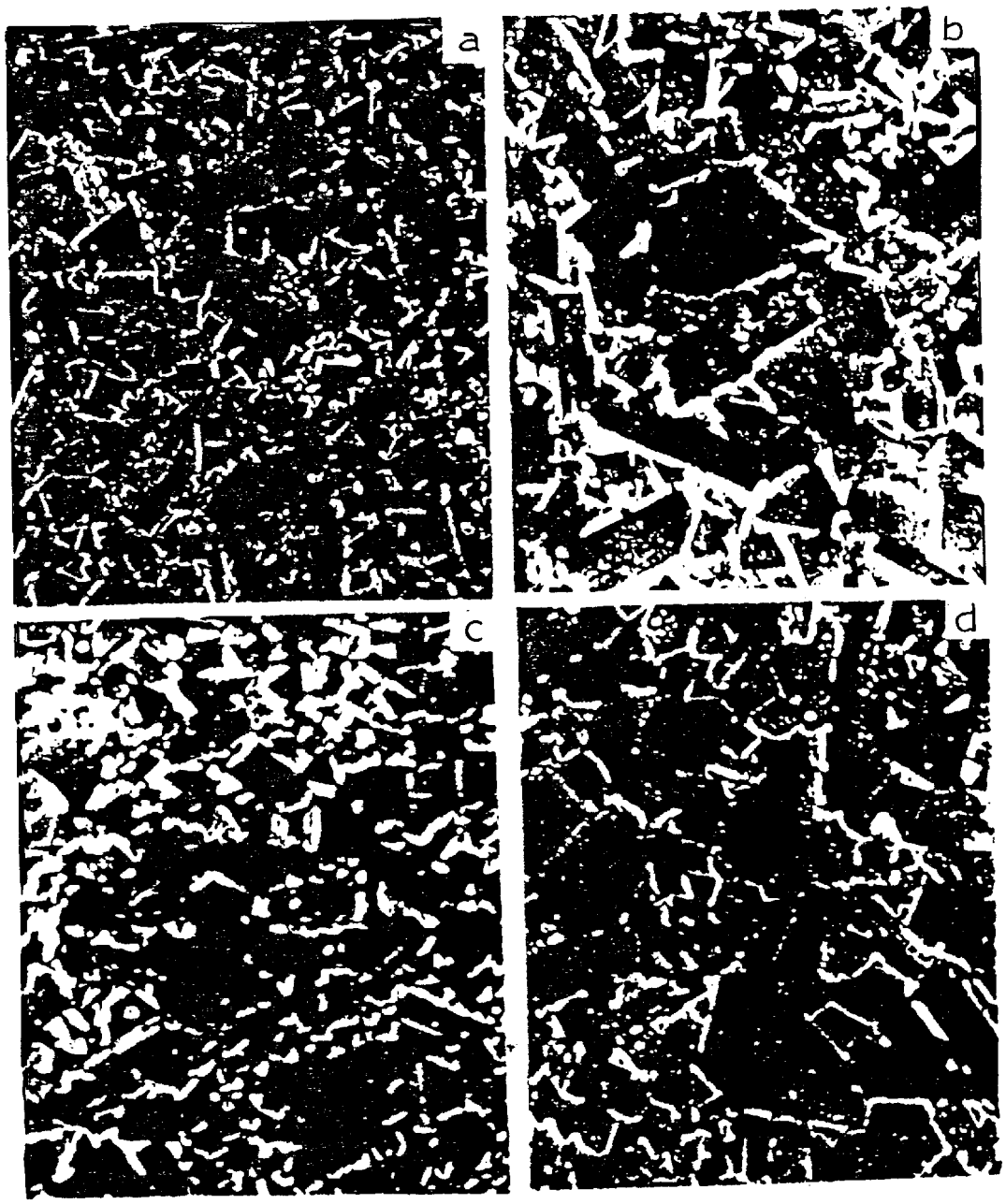
FIG. 3 is set of REM photographs of a structure of reactively sintered WC—6Co hard metals of 2.4 $\mu$m W-powder, which has been produced with and without VC through microwave sintering(Photo a, c) and through conventional sintering (photo b, d)
Figure 4:
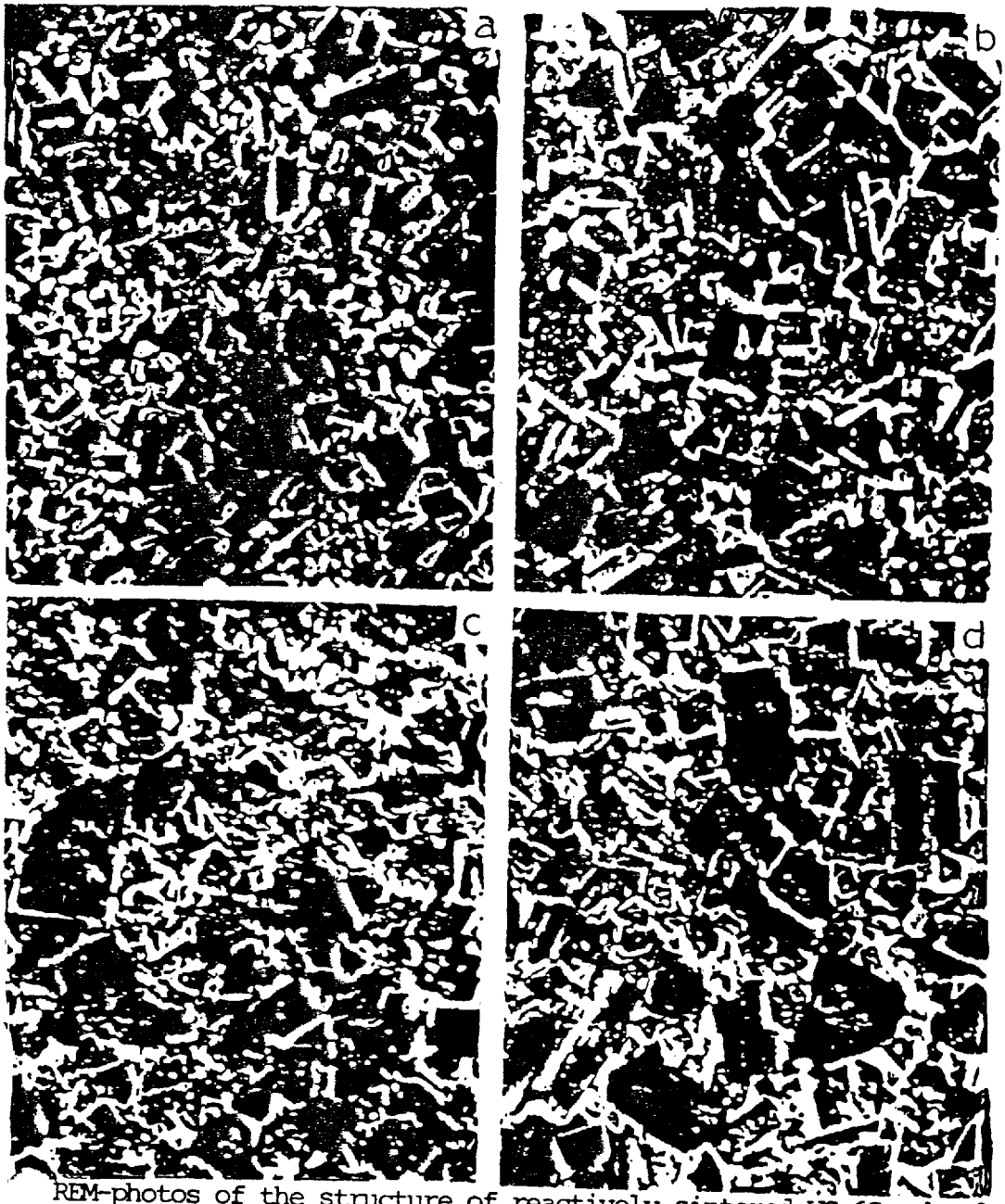
FIG. 4 is a set of REM photographs corresponding to those of FIG. 3 with the indication that 0.4 $\mu$m W-powder was used.
Figure 5:
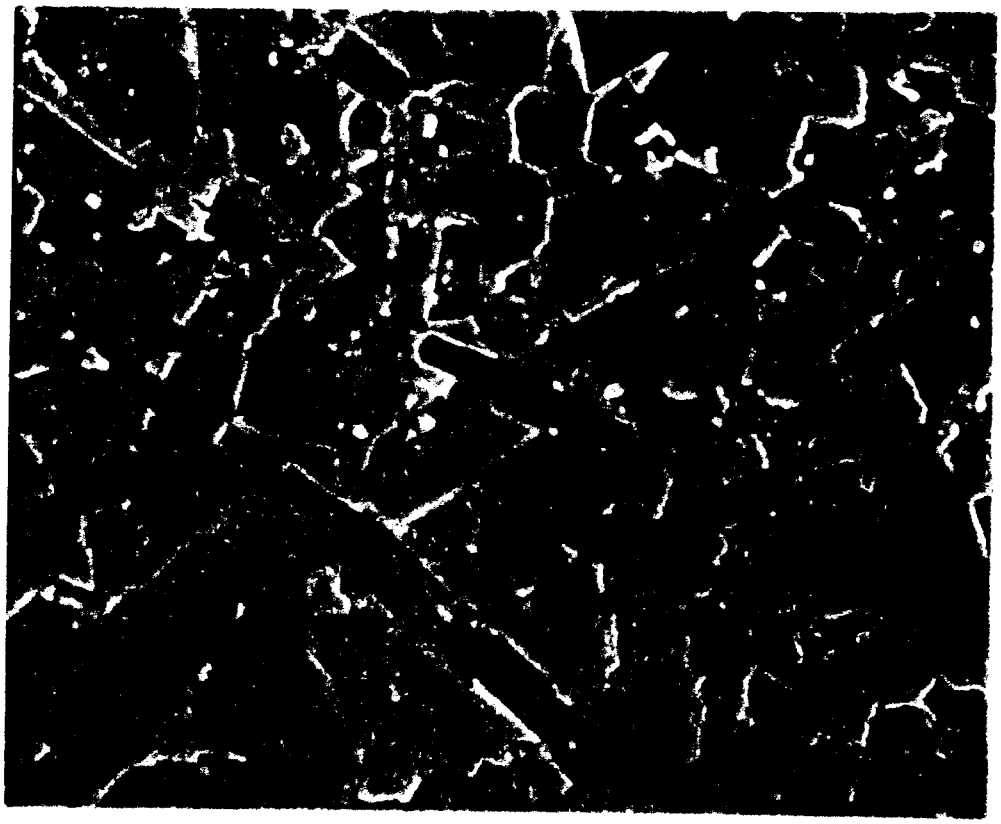
FIG. 5 is a REM photograph of a hard metal body produced according to the invention.

In order to test the effect of the size of the primary tungsten particles and the addition of VC as grain growth inhibitor in reactive sintering, WC—6 M % Co hard metals were produced with tungsten powders of various fineness by means of conventional (RS) and microwave heating (MWRS). The used tungsten powders had an average grain size of 0.4 μm, 1 μm and 2.4 μm (each FSSS) at dopings of 0.2 M % VC or without VC. As cobalt powder each time a quality with an FSSS value of 1.6 m was used. For the sake of comparability, all RS samples, not depending on the fineness of the tungsten powder, were densely sintered conventionally at a temperature of 1430° C. (for 30 minutes), and all MWRS samples were densely sintered by means of microwaves at a temperature of 1400° C. (for 20 minutes) up to a residual porosity smaller than AO8, BO4 (ISO). Subsequently the structure was examined with an electronic microscope, the hardness, the magnetic saturation and the coercive field intensity were established as well. FIGS. 3 and 4 show the micrographs of the hard metals made of tungsten powders with the particle sizes of 2.4 μm and 0.4 μm respectively for both sintering methods and VC contents. With all used tungsten particle sizes, the structure of the sample resulting from the microwave reactive sintering is always the finest. The influence of the VC content on the structure is obviously the greatest in the case of fine tungsten powders. In the alloys without VC the WC crystals, particularly in the RS samples, have obviously enough time for growth during sintering phase without VC.

It is remarkable to observe the anisotropic grain growth which is typical for the conditions in reaction sintering. If in the corresponding sintering stages the WC nuclei are afforded opportunity for grain growth, then, as represented in FIG. 4, it is possible with conventionally available W-powders to control the in situ production of WC platelets during reactive sintering. Plate-shaped (disk-shaped) WC crystals with an aspect ratio (diameter to thickness) of up to 10 can be thus produced. WC platelets in hard metals, due to the anisotropic hardness characteristics of WC crystals, as known increase the hardness as well as the breaking resistance of the composite material. The heretofore described methods for the production of such platelets start out mostly from nanocrystalline WC powders, and then add the platelets to the hard metal during the preparation of the mixture.

Therefore with the microwave reactive sintering process it is possible to produce dense composite bodies, in which in an ultra-fine hard metal matrix with high hardness and strength platelets produced in situ are embedded. These platelets serve as a mechanical reinforcement of the hard metal, and as known increase the wear resistance and impact resistance during the use of the composite bodies as cutting materials in machining processes.

The method of the invention is not in any way limited to an initial grain size distribution which is as unimodal as possible, moreover it can work with powders with a broader or bimodal size distribution.

The sintering of hard metals and cermets in the microwave field makes possible a refining of the structure compared to the conventional sintering technology, due to the described heating mechanism and the thereby achievable shorter sintering times and lower sintering temperatures. Further more the microwave reactive sintering with mixtures of metallic tungsten powders, carbon and cobalt leads to finer structures than the conventional process with WC—Co as a starting material.

Regarding the material composition of the hard metals and cermets, all materials which have free WC in their structure can be involved. The reactive sintering of powders, which contain tungsten as well as carbon, but can also contain WC in the initial mixture, can be performed as a complete, but also as a partial reactive sintering, whereby the proportion of the partial reactive sintering ranges between 1% and 100% (in relation to the complete sintering process). Depending on the share of the microwave reactive sintering in the entire microwave sintering process, the grain growth can be controlled in the sintered body.

Also the WC platelets growth can be controlled via the share of the partial reactive sintering, whereby the platelet concentration in the sintered body is controllable. The proportion by volume of the WC platelets in relation to the total volume of the sintered body amounts preferably up to 25% by volume. Particularly the proportion of platelets, measured as a surface proportion of a metallographic section should not surpass a maximum of 20%, whereby all WC crystals should have a length/width ratio, the so-called aspect ratio, higher than 3. The maximal aspect ratio amounts preferably to max. 10±1. Also depending on the fineness of the tungsten powder in the initial mixture, the speed of the growth can be controlled. Further control possibilities result from the addition of grain growth inhibitors, such as particularly VC, preferably in amount of 0.2% by mass, which promote the platelets growth on account of the giant grain growth. Further control possibilities can be achieved by process technology via the temperature holding times and the temperature level during sintering.

The advantage of the microwave reaction sintering consist in that a homogeneous microstructure, a better densification, i.e. a lower residual porosity can be achieved, just as well as shorter sintering times and lower sintering temperatures. This results in lower production costs.

Regarding the material composition, as well as the process technology, reference is made to publications mentioned in the introduction, including the German patent application 196 01 234.1.

In a concrete embodiment, 0.4 $\mu$m W-powder, 0.2% addition of VC, 6% Co-powder of a grain size of 1.6 $\mu$m, as well as a stoichiometric addition of carbon in the form of soot, are mixed and ground for 36 hours in a ball type mill with the addition of acetone, prior to the subsequent addition of 2% wax as an auxiliary compression and the volatiles are distilled off and the product granulated.

The granulate is compressed by means of a die press into green compacts and heated in the microwave sintering oven at 500° C./hour up to 900° C. and then with the onset of the carbonization reaction heated within 10 minutes by means of microwave to the sintering temperature of 1350° C. After a waiting time of 20 minutes the sample is cooled by turning off the microwave heating.

What is claimed is:

1. A hard metal or cermet sintered body consisting of at least one WC-containing hard material phase and a binder phase, and WC platelets embedded therein as a reinforcement and formed by compressing a powder mixture of tungsten and carbon in preparations required for the formation of the hard material phase and the platelets and a binder metal into a shaped body and microwave sintering the body by reactive sintering in a microwave field with an average density of 0.01 to 10 W/cm$^2$.

2. The hard metal or cermet sintered body defined in claim 1 which contains up to 12% VC and/or $Cr_3C_2$ in relation to the binder phase.

3. The hard metal or cermet sintered body defined in claim 2 which contains up to 8% VC and/or $Cr_3C_2$ in relation to the binder phase.

4. A microwave sintered hard metal or cermet body consisting of at least one WC-containing metal phase and a binder phase and WC platelets embedded therein and formed by mixing at least tungsten, carbon and a binder metal in powdered form and compressing the mixture to a shaped body and subjecting the shaped body to reactive sintering in a microwave field of 0.01 to 10 W/cm$^2$ energy density and forming the WC platelet with a diameter/thickness ratio of greater than or equal to 3.

5. The microwave sintered hard metal or cermet body defined in claim 4 wherein said diameter/thickness ratio is $\geqq 5$.

6. The microwave sintered hard metal or cermet body defined in claim 5 wherein said WC platelets are present in the microwave sintered body in a preparation of at most 25% by volume.

7. A method of producing a hard metal or cermet body which comprises the steps of:

mixing substances required for forming a hard metal or cermet hard material phase, carbon and a preparation of tungsten sufficient with said carbon for forming WC platelets to be embedded in said body, and optionally other metals, metal carbides and nitrides and/or solid nitrogen compounds supplying carbon and/or nitrogen to form a powder mixture;

pressing said powder mixture into a shaped body; and reactively sintering said shaped body in a microwave field of 0.01 to 10 W/cm$_2$ energy density to form a sintered body consisting of at least one WC-containing hard material phase and a binder phase and embedded WC platelets.

8. The method defined in claim 7 wherein in said sintered body a fraction thereof including at least the WC is produced by reactive sintering and said sintered body contains another fraction added in the chemical form to said mixture in which said other fraction is found in said sintered body.

9. The method defined in claim 7 wherein the growth of said WC platelets is controlled by the share of microwave reactive sintering in relation to an entire sintering process utilizing microwaves.

10. The method defined in claim 7 wherein a grain growth inhibitor is added to said mixture.

11. The method defined in claim 10 wherein said grain growth inhibitor is VC and/or $Cr_3C_2$ added to said mixture in an amount up to 12%.

12. The method defined in claim 11 wherein said grain growth inhibitor is added to said mixture in an amount up to 8%.

* * * * *